US012630968B2

(12) United States Patent
Lee et al.

(10) Patent No.: US 12,630,968 B2
(45) Date of Patent: May 19, 2026

(54) CLOTHES DRYER

(71) Applicant: SAMSUNG ELECTRONICS CO., LTD., Suwon-si (KR)

(72) Inventors: Gihyun Lee, Suwon-si (KR); JongHyun Jang, Suwon-si (KR); Myungwon Jeon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 807 days.

(21) Appl. No.: 17/859,253

(22) Filed: Jul. 7, 2022

(65) Prior Publication Data

US 2022/0333294 A1 Oct. 20, 2022

Related U.S. Application Data

(63) Continuation of application No. PCT/KR2020/017385, filed on Dec. 1, 2020.

(30) Foreign Application Priority Data

Jan. 28, 2020 (KR) ..... 10-2020-0010137

(51) Int. Cl.
*D06F 58/22* (2006.01)
*D06F 58/02* (2006.01)

(52) U.S. Cl.
CPC ..... *D06F 58/22* (2013.01); *D06F 58/02* (2013.01)

(58) Field of Classification Search
CPC ..... D06F 58/02; D06F 58/22
USPC ..... 34/82
See application file for complete search history.

(56) References Cited

U.S. PATENT DOCUMENTS 6,678,969 B1 1/2004 Hong
7,866,061 B2 * 1/2011 Tatsumi ..... D06F 58/206 34/607
9,096,970 B2 8/2015 Ko et al.
9,163,351 B2 10/2015 Kim et al.
2005/0076535 A1 * 4/2005 Guinibert ..... D06F 58/04 34/601
2018/0044845 A1 * 2/2018 Bocchino ..... B01D 46/58
(Continued)

FOREIGN PATENT DOCUMENTS

CN 1475622 A 2/2004
EP 3 118 367 A1 1/2017
JP 2017-38849 A 2/2017
(Continued)

OTHER PUBLICATIONS

Notice of Preliminary Rejection issued Dec. 31, 2024 for Korean Application No. 10-2020-0010137.
(Continued)

*Primary Examiner* — Connor J Tremarche
(74) *Attorney, Agent, or Firm* — STAAS & HALSEY LLP

(57) ABSTRACT

A clothes dryer comprises a main body, a drum including an entrance provided to allow an object to be dried to be placed in the drum, the drum being installed inside the main body, a drying unit installed inside the main body to dry air passing through the drum, a first filter arranged adjacent to the entrance of the drum to filter air discharged from the drum, a second filter arranged between the first filter and the drying unit so as to filter air passing through the first filter, and a third filter provided to filter air passing through the second filter.

10 Claims, 13 Drawing Sheets

(56) References Cited

U.S. PATENT DOCUMENTS

2018/0245271 A1* 8/2018 Bocchino ..... D06F 58/22

FOREIGN PATENT DOCUMENTS

| | | | |
|---|---|---|---|
| JP | 2019-92900 | A | 6/2019 |
| JP | 6873485 | B2 | 5/2021 |
| KR | 10-0737320 | | 7/2007 |
| KR | 10-0764344 | B1 | 10/2007 |
| KR | 10-2010-0099445 | | 9/2010 |
| KR | 10-2011-0122465 | | 11/2011 |
| KR | 10-2018-0066469 | A | 6/2018 |
| KR | 10-2018-0129610 | A | 12/2018 |
| KR | 10-2201868 | B1 | 1/2021 |
| WO | WO 2005/090669 | A2 | 9/2005 |

OTHER PUBLICATIONS

International Search Report issued in International Application No. PCT/KR2020/017385 dated Apr. 8, 2021.
International Written Opinion issued in International Application No. PCT/KR2020/017385 dated Apr. 8, 2021.
Notice of Allowance issued May 13, 2025 for Application No. 10-2022-0010137.

* cited by examiner

CLOTHES DRYER

CROSS-REFERENCE TO RELATED APPLICATIONS

This application is a continuation application, under 35 U.S.C. § 111(a), of International Patent Application No. PCT/KR2020/017385, filed on Dec. 1, 2020, which claims the benefit of Korean Patent Application No. 10-2020-0010137, Jan. 28, 2020, in the Korean Intellectual Property Office, the entire disclosures of each of which are incorporated herein by reference as a part of this application.

BACKGROUND

Field

The present disclosure relates a clothes dryer.

Description of Related Art

A clothes dryer is a device that dries wet laundry with hot and dry air.

In general, the clothes dryer is classified into a gas dryer and an electric dryer according to a power source, and is classified into a vented dryer and a condenser dryer according to a method of removing moisture absorbed from an object to be dried.

The vented dryer discharges humid air from a drum to the outside through a long exhaust duct.

The condenser dryer uses a circulation method in which moisture in humid air flowing from a drum is removed through a heat exchanger and the dried air is transferred to the drum again. Because the flow of air forms a closed loop, it is difficult to use gas as a heat source and thus the electricity is used, which causes a relatively high maintenance cost. However, the air is circulated between an object to be dried in the drum and the heat exchanger, and thus the exhaust duct is not required, which causes the simple installation.

On the other hand, when wet clothes in the drum is dried, lint (fluff) is generated. The lint moves along a flow path together with the air and adheres to the heat exchanger inside the condenser dryer. In general, a filter for filtering out lint is installed in a flow path close to an inlet of the heat exchanger.

The lint accumulated on the filter may block the flow of the air. Accordingly, the heat exchange efficiency is lowered, and the performance of the dryer is eventually deteriorated. In order to prevent this, it is required to periodically clean the filter.

SUMMARY

One aspect of the present disclosure provides a clothes dryer including a main body, a drum including an entrance provided to allow an object to be dried to be placed in the drum, the drum being installed inside the main body, a drying unit installed inside the main body to dry air passing through the drum, a first filter arranged adjacent to the entrance of the drum to filter air discharged from the drum, a second filter arranged between the first filter and the drying unit so as to filter air passing through the first filter, and a third filter provided to filter air passing through the second filter.

The first filter may be formed with a metal thin film including a plurality of holes.

The plurality of holes may be formed by etching the metal thin film.

The clothes dryer may further include a front frame provided to form a part of a circulation path through which air circulates between the drum and the drying unit, wherein the first filter is mounted on the front frame.

The front frame may include a mounting member provided to support one surface of the first filter to allow the first filter to be mounted thereto, a side flange formed to extend from one side of the mounting member to fix one side of the first filter, and a bottom flange formed to extend from a lower portion of the mounting member to fix a bottom of the first filter and including an opening to form a part of the circulation path.

The second filter may be arranged on the bottom flange to cover the opening.

The clothes dryer may further include a fan drive including a blower fan arranged therein, the fan drive arranged below the front frame so that air flows to the opening.

The second filter may include a fixing frame including a grid-shaped rib, and a filter member fixed to the fixing frame.

The filter member may include a sponge material and be provided in a mesh shape.

The filter member may be formed with a metal thin film including a plurality of holes.

The plurality of holes may be formed by etching the metal thin film.

The filter member may be fixed to the fixing frame by a double-sided tape or an adhesive.

The filter member may be injection-molded integrally with the fixing frame.

The clothes dryer may further include a filter assembly to which the third filter is coupled, the filter assembly provided to form a part of the circulation path and connected to the drying unit.

The filter assembly may include a first side provided to face the fan drive, and formed to be open to allow air to be introduced from the fan drive, and a second side provided to face the drying unit and formed to be open to allow the air, which is introduced from the first side, to be guided to the drying unit.

The second side may further include a coupling member including a coupling groove provided to allow the third filter to be slidably coupled thereto.

The third filter may include a first filtering member including a mesh shape and a second filtering member including a mesh shape and removably coupled to the first filtering member.

The first filtering member may include an edge provided with at least one groove, and the second filtering member may include an edge provided with at least one protrusion corresponding to the at least one groove of the first filtering member.

DETAILED DESCRIPTION

Figure 1:
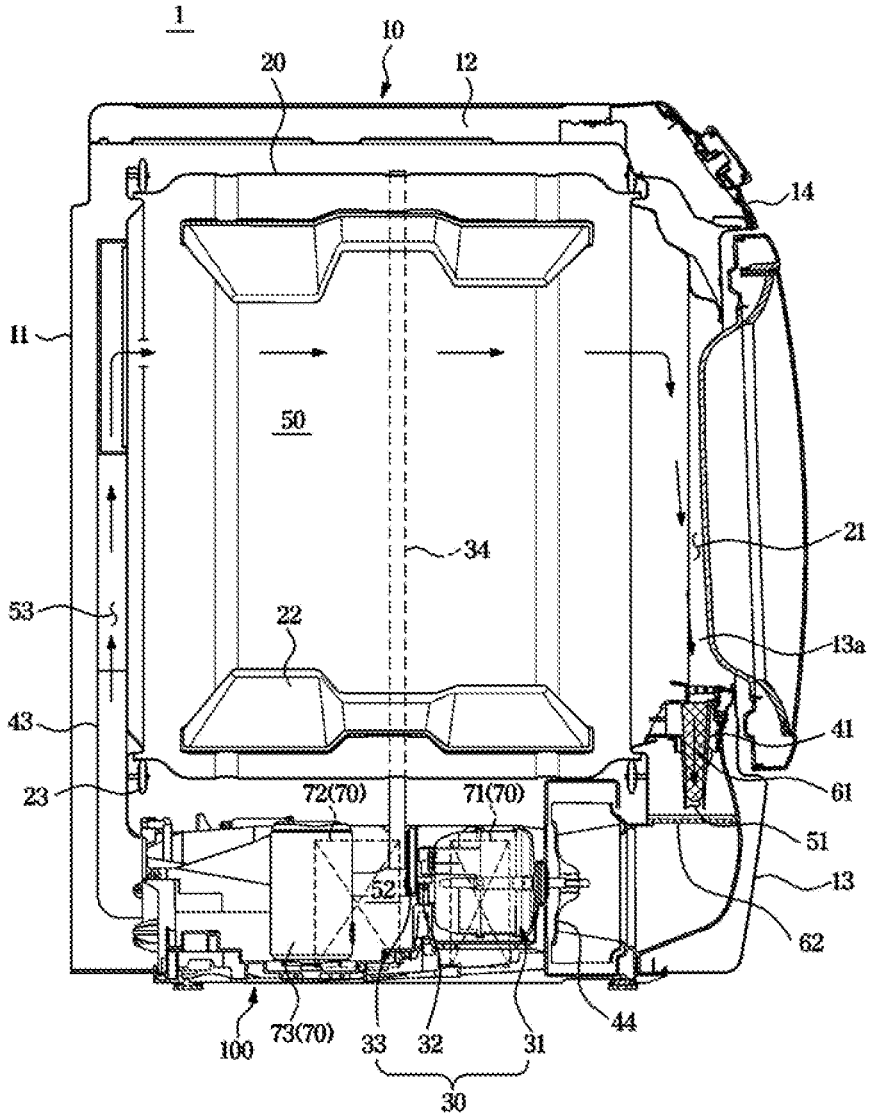
FIG. 1 is a cross-sectional view of a clothes dryer according to one embodiment of the present disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element.

The present disclosure is directed to providing a clothes dryer capable of forming a primary filter with a thin film including a plurality of holes so as to collect lint with a relatively small size and to increase an amount of air passing through the plurality of holes, thereby improving a drying efficiency.

Further, the present disclosure is directed to providing a clothes dryer capable of providing a secondary filter to cover an opening of a front frame so as to prevent a condition in which a fabric falls into a fan drive, which causes a damage in the fabric or a malfunction in the fan drive.

Further, the present disclosure is directed to providing a clothes dryer capable of forming a tertiary filter, which is coupled to a filter assembly, in a dual structure including a first filtering member and a second filtering member, thereby improving an efficiency of collecting dust and lint.

Further, the present disclosure is directed to providing a clothes dryer capable of providing a tertiary filter being coupled to a filter assembly in a sliding manner, thereby easily assembling the tertiary filter and the filter assembly, and thereby preventing abrasion and whitening of a portion in which the tertiary filter is coupled to the filter assembly.

A clothes dryer may form a primary filter with a thin film including a plurality of holes so as to collect lint with a relatively small size and to increase an amount of air passing through a plurality of holes, thereby improving a drying efficiency.

Further, a clothes dryer may provide a secondary filter to cover an opening of a front frame so as to prevent a condition in which a fabric falls into a fan drive, which causes a damage in the fabric or a malfunction in the fan drive.

Further, a clothes dryer may form a tertiary filter, which is coupled to a filter assembly, in a dual structure including a first filtering member and a second filtering member, thereby improving an efficiency of collecting dust and lint.

Further, a clothes dryer may provide a tertiary filter being coupled to a filter assembly in a sliding manner, thereby easily assembling the tertiary filter and the filter assembly, and thereby preventing abrasion and whitening of a portion in which the tertiary filter is coupled to the filter assembly.

The disclosure will be described more fully hereinafter with reference to the accompanying drawings.

FIG. 1 is a cross-sectional view of a clothes dryer according to one embodiment of the present disclosure.

As shown in FIG. 1, a clothes dryer 1 may include a main body 10 and a drum 20 rotatably provided in the main body 10.

The main body 10 may include an upper plate 12, a left plate (not shown), a right plate (not shown), a front plate 13, a rear plate 11, and a base 100. In the embodiment of the present disclosure, the front plate 13, the upper plate, the left plate, the right plate, etc. forming the main body 10 are separately provided and assembled to each other, but the present disclosure is not limited thereto. For example, at least a portion of the main body 10, the front plate 13, the upper plate, the left plate, the right plate, etc. may be integrally formed with each other.

An inlet 13*a* is formed in the front plate 13 of the main body 10 to put or withdraw clothes, which are objects to be dried, into or from the drum 20. The inlet 13*a* may be opened and closed by a door. A control panel 14 configured to control an operation of the clothes dryer 1 may be provided on an upper portion of the main body 10.

The drum 20 may be provided inside the main body 10 to accommodate the object to be dried. An entrance 21 may be formed on a front surface of the drum 20 to correspond to the inlet 13*a*. The entrance 21 may also be opened and closed by the door. A plurality of lifters 22 may be arranged inside the drum 20 along a circumferential direction of the drum 20. The lifter 22 raises and falls the object to be dried to allow the object to be dried to be effectively dried. A roller 23 provided to support the drum 20 to rotate smoothly may be provided on an outer circumferential surface of the drum 20.

The clothes dryer 1 may include a drive device 30 configured to drive the drum 20. The drive device 30 may include a drive motor 31 mounted on the base 100. The drive motor 31 may include a pulley 33 and a belt 34. The pulley 33 may be connected to a rotating shaft 32 connected to the drive motor 31. In response to the rotation of the rotating shaft 32 by the drive motor 31, the pulley 33 may also rotate together with the rotating shaft 32. The belt 34 may connect the pulley 33 and the drum 20 so as to transmit the rotation of the pulley 33 to the drum 20.

The clothes dryer 1 may circulate air to dry the object to be dried inside the drum 20. The main body 10 may include a duct 40 provided to form a circulation path for removing humid air, which is in the drum 20, from the drum 20 and for supplying dry air to the drum 20.

The duct 40 may include an inlet duct 41 introducing the humid air inside the drum 20 into a drying unit 70, an outlet duct 43 discharging hot air to the drum 20, and a connection duct 42 connecting the inlet duct 41 and the outlet duct 43.

A circulation path 50 through which air flows may be formed in the inside of the duct 40. The circulation path 50 may include an inlet flow path 51, a connection flow path 52, and an outlet flow path 53. The inlet flow path 51 may be formed by the inlet duct 41 provided to introduce air passing through the inside of the drum 20. The connection flow path 52 may be connected to the outlet flow path 53. The connection flow path 52 may be formed by the connection duct 42 connecting the inlet duct 41 and the outlet duct 43. The outlet flow path 53 may be connected to the connection flow path 52. The outlet flow path 53 may be formed by the outlet duct 43 discharging hot air to the drum 20. The inlet duct 41 may be arranged in a lower portion of the front surface of the drum 20. The outlet duct 43 may be arranged at the rear of the drum 20. The connection duct 42 may be arranged below the drum 20. The connection duct 42 may be installed on the base 100.

The outlet duct 43 may be arranged at the rear of the drum 20 to allow high-temperature and low-humidity air to be supplied into the drum 20 through the outlet duct 43. An object to be dried inside the drum 20 may be dried by the high-temperature and low-humidity air. The air, after drying the object to be dried, may be in a high-temperature and high-humidity state. The high-temperature and high-humidity air in the drum 20 may be discharged under the drum 20 through the inlet duct 41.

A first filter 61 may be installed in the inlet duct 41. The first filter 61 may filter out foreign substances such as lint and fluff contained in the air passing through the drum 20. The air filtered by the first filter 61 may be discharged into the drum 20 through the connection duct 42 and the outlet duct 43.

The high-temperature and high-humidity air inside the drum 20 is introduced into heat exchangers 71 and 72 along the inlet flow path 51 in the inlet duct 41. Air, which is changed to a high-temperature and low-humidity state after passing through the heat exchangers 71 and 72 (refer to FIG. 2), may be discharged back into the drum 20 along the outlet flow path 53 in the outlet duct 43 and circulated. This circulation of air may be induced by a blower fan 44 installed on the inlet flow path 51.

The clothes dryer 1 may include the blower fan 44. The blower fan 44 may introduce high-temperature and high-humidity air of the drum 20 into the circulation path 50 and generate a circulation flow that discharges the high-temperature and low-humidity air passing through the heat exchangers 71 and 72 to the drum 20. The blower fan 44 may be driven together by the drive motor 31 configured to drive the drum 20, but is not limited thereto.

Figure 2:
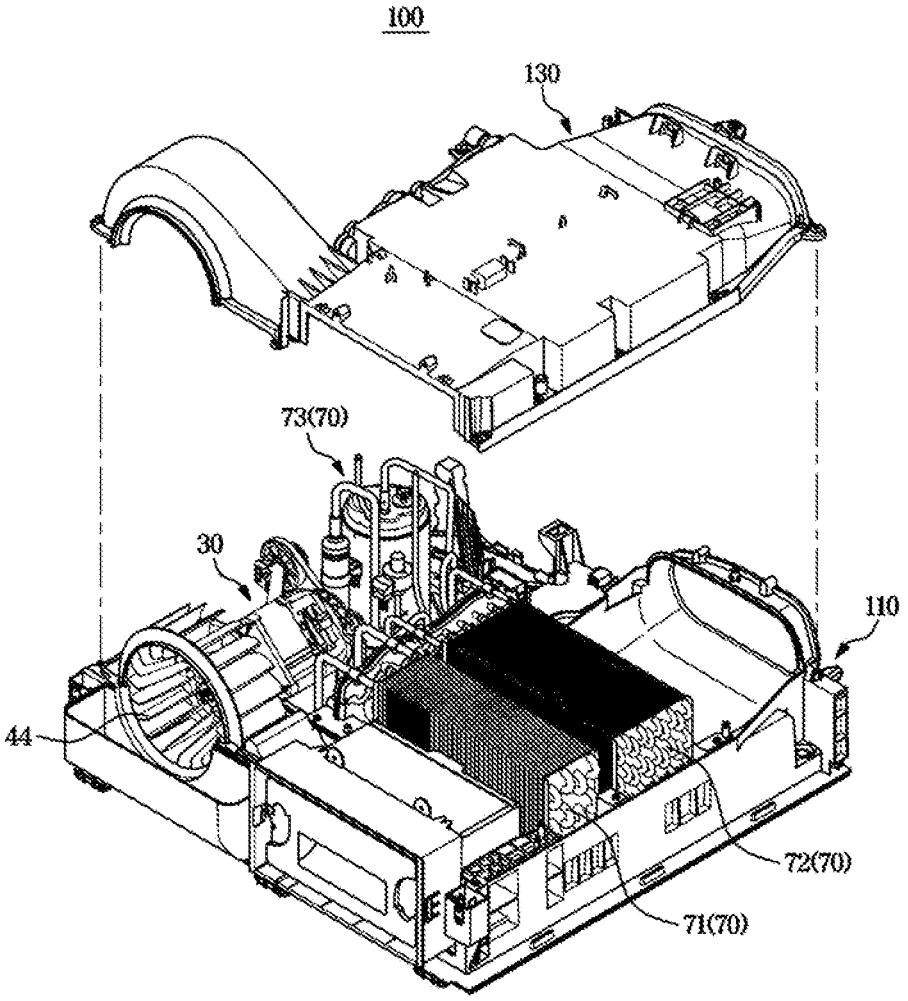
FIG. 2 is an exploded-perspective view of a base of the clothes dryer of FIG. 1 according to an embodiment of the present disclosure.

FIG. 2 is an exploded-perspective view of a base of the clothes dryer of FIG. 1.

As shown in FIG. 2, the clothes dryer 1 may include the base 100. The base 100 may be arranged under the drum 20 to accommodate various components. The above-described heat exchangers 71 and 72, the drive device 30, and the blower fan 44 may be accommodated in the base 100 and mounted thereon.

The base 100 may include a body 110 and a cover 130 provided to form the flow path through which air flows. The cover 130 may cover the drying unit 70 and the blower fan 44. A portion of the cover 130 may form the connection duct 42. The circulation path 50 through which air flows may be formed inside the cover 130.

The drying unit 70 may include an evaporator 71, a condenser 72, and a compressor 73. The heat exchangers 71 and 72 may include the evaporator 71 and the condenser 72. In addition, although not shown, the drying unit 70 may further include an expansion valve.

The high-temperature and high-humidity air discharged from the drum 20 is introduced into the heat exchangers 71 and 72 through the blower fan 44. The high-temperature and high-humidity air may first pass through the evaporator 71 of the drying unit 70. A refrigerant that expands due to pressure drop and absorbs heat may flow inside the evaporator 71. The refrigerant absorbs heat while evaporating in the evaporator 71, and the high-temperature and high-humidity air is cooled and loses moisture thereof so as to be a low-temperature and low-humidity air while passing through the evaporator 71. That is, the high-temperature and high-humidity air discharged from the drum 20 is changed into low-temperature and low-humidity air while passing through the evaporator 71.

The low-temperature and low-humidity air after passing through the evaporator 71 may pass through the condenser 72. A refrigerant compressed and superheated by the compressor 73 may flow inside the condenser 72. The superheated refrigerant releases heat while flowing through the condenser 72, and the low-temperature and low-humidity air is heated and becomes high-temperature and low-humidity air while passing through the condenser 72. That is, the low-temperature and low-humidity air after passing through the evaporator 71 is changed to high-temperature and low-humidity air while passing through the condenser 72.

In response to the start of a drying operation, the drive motor 31 operates, and thus the drum 20 and a circulation fan operate. The circulation fan generates the air flow. As the air passes through the evaporator 71 and the condenser 72, the air may be changed into high-temperature and low-humidity air and introduced into the drum 20. The high-temperature and low-humidity air introduced into the drum 20 removes moisture of an object to be dried accommodated in the drum 20 so as to dry the object. At the same time, the air is changed into high-temperature and high-humidity air. The high-temperature and high-humidity air may be introduced back into the heat exchangers 71 and 72 along the inlet flow path 51 and then changed into high-temperature and low-humidity air. The high-temperature and low-humidity air may be discharged back to the drum 20.

Figure 3:
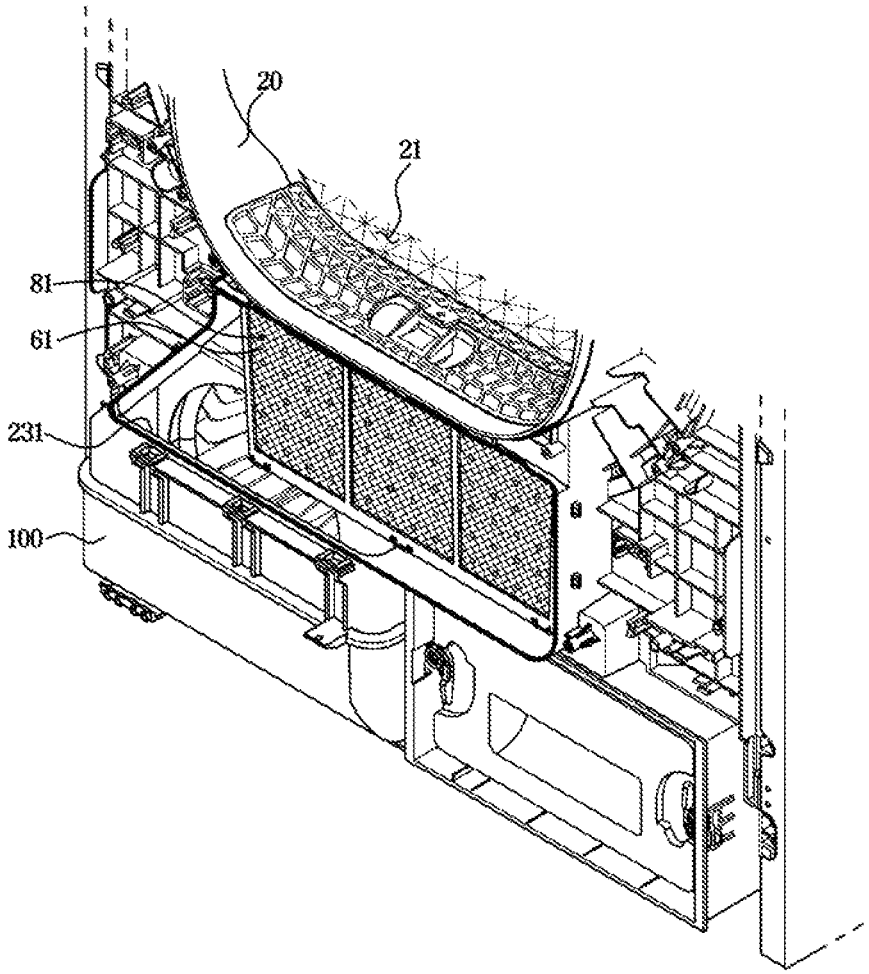
FIG. 3 is a perspective view of a first filter provided under a drum of the clothes dryer of FIG. 1 according to an embodiment of the present disclosure.
Figure 4:
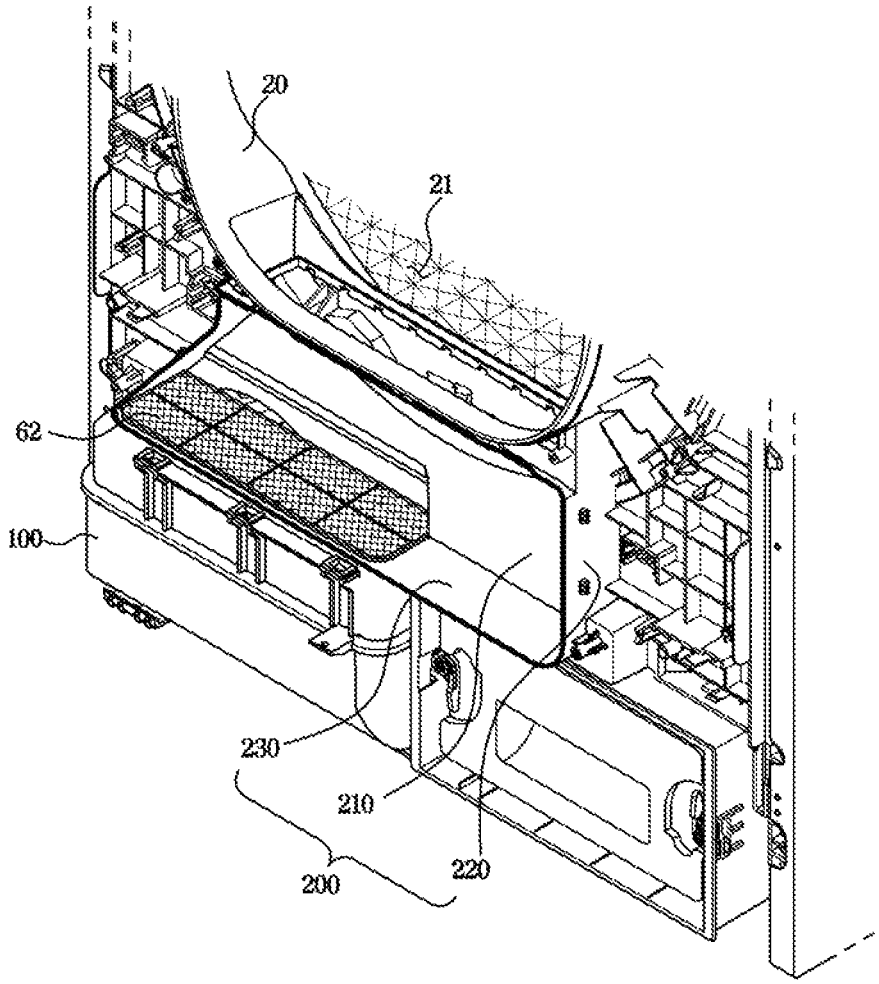
FIG. 4 is a perspective view of a front frame, to which the first filter of FIG. 3 is mounted, and a second filter provided on a lower end of the front frame according to an embodiment of the present disclosure.
Figure 5:
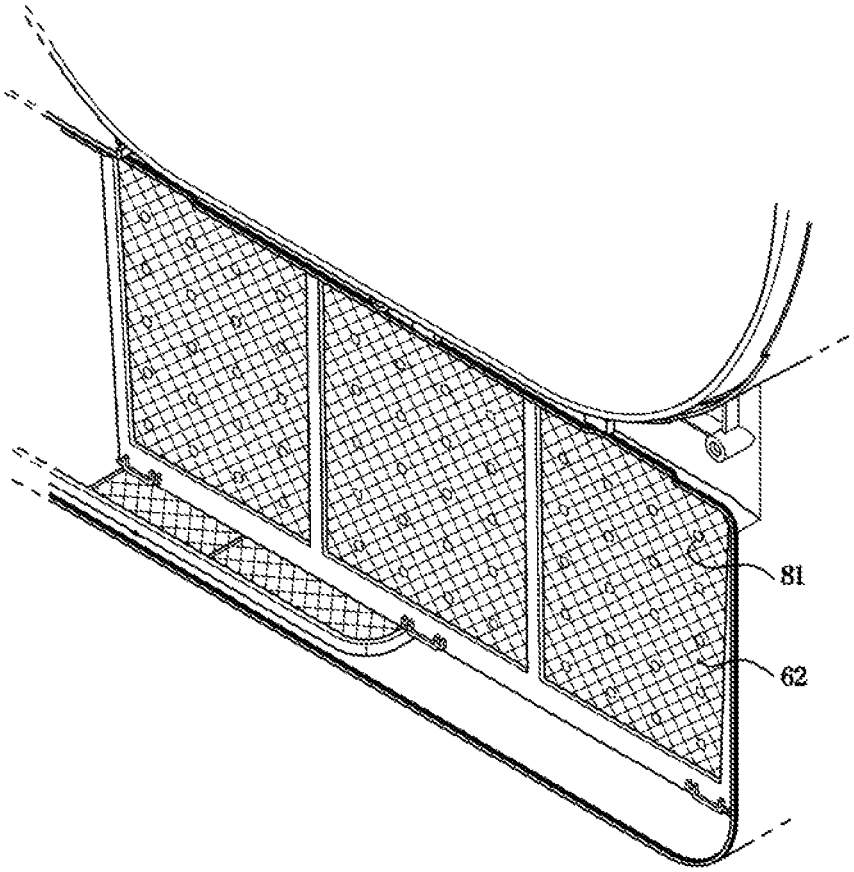
FIG. 5 is an enlarged view of the first filter of FIG. 3 according to an embodiment of the present disclosure.

FIG. 3 is a perspective view of a first filter provided under a drum of the clothes dryer of FIG. 1, FIG. 4 is a perspective view of a front frame, to which the first filter of FIG. 3 is mounted, and a second filter provided on a lower end of the front frame, and FIG. 5 is an enlarged view of the first filter of FIG. 3.

Referring to FIG. 3, the first filter 61 is located adjacent to the entrance 21 of the drum 20. The first filter 61 may be located below the entrance 21 of the drum 20, and filter the air discharged from the drum 20.

Referring FIG. 5, the first filter 61 may include a metal thin film. The first filter 61 may include a plurality of holes 81 through which air is filtered while passing therethrough.

It is appropriate that the plurality of holes 81 is formed with fine pores to collect finer dust, lint, and the like contained in the air. The plurality of holes 81 may be formed through an etching process using a fine metal mask (FMM), and accordingly, may be provided to have a diameter of a nano size.

The hole 81 on the metal thin film may be formed in a nano size so as to collect fine dust, lint, etc., and the hole 81 may be provided in plurality so as to increase an amount of air passing through the holes 81, thereby improving the drying efficiency.

A fan drive is installed on an air movement path to allow the drum 20 and the drying unit 70 to communicate with each other so as to allow air to be circulated. The fan drive may include the drive device 30 and the blower fan 44 described above, and regulate the air movement. The fan drive serves to move the air discharged from the drum 20 to the drying unit 70.

As illustrated above, the base 100 including the fan drive may be located below the first filter 61. Air discharged from the drum 20 and passing through the first filter 61 may be moved downward toward the base 100 and introduced into the fan drive. An opening 231 is provided in a front frame 200 (refer to FIG. 4), to which the first filter 61 is mounted, to allow the air to flow into the base 100. Accordingly, the air filtered by the first filter 61 passes through the opening 231 and moves to the inside of the fan drive, and moves to the drying unit 70 by the blower fan 44.

Referring to FIG. 4, the front frame 200 forms a part of the circulation path, through which the drum 20 and the drying unit 70 communicate with each other to circulate air. Particularly, the front frame 200 to which the first filter 61 is mounted includes a mounting member 210 supporting one surface of the first filter 61, a side flange 220 extending from one side the mounting member so as to fix one side of the first filter 61, and a bottom flange 230 extending from a lower end of the mounting member 210 to fix a bottom of the first filter 61.

The opening 231 is provided in the bottom flange 230 to form a part of the circulation path. The air passes through the opening 231 of the bottom flange and moves to the inside of the base 100 and then moves to the drying unit 70.

On the other hand, when a user puts clothes into the drum 20 for drying the clothes or takes out clothes that have been dried from the drum 20, the clothes may fall into the inside of the base 100, in which the fan drive is installed, through the opening 231. Accordingly, the clothes falling into the base 100 may cause a failure of the fan drive and the clothes may be damaged by the fan drive.

To prevent this, as shown in FIG. 4, a second filter 62 is provided on the bottom flange 230 to cover the opening 231. The second filter 62 may be provided in a plate shape to cover the opening 231. However, the present disclosure is not limited thereto, and the second filter 62 may be provided in various shapes to cover the opening 231.

The second filter 62 may prevent clothes from moving to the inside of the base 100 by passing through the opening 231, and further the second filter 62 may be positioned between the first filter 61 and the drying unit 70 so as to collect dust and lint contained in the air passing through the first filter 61.

Figure 6A:
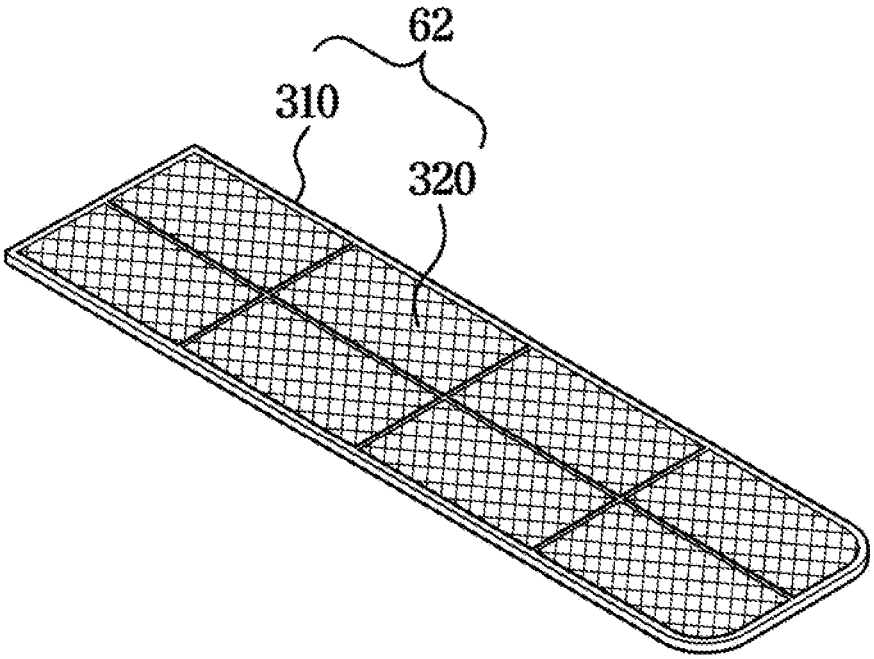
FIG. 6A is a view of an example of the second filter of FIG. 3 according to an embodiment of the present disclosure.
Figure 6B:
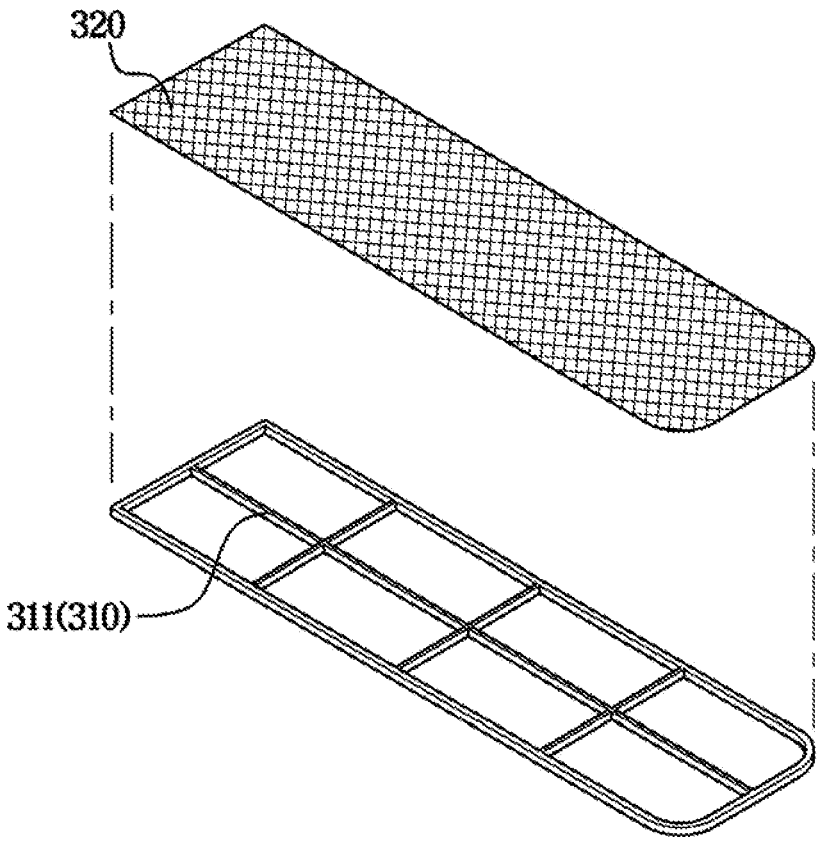
FIG. 6B is an exploded-perspective view of the second filter of FIG. 6A according to an embodiment of the present disclosure.
Figure 7A:
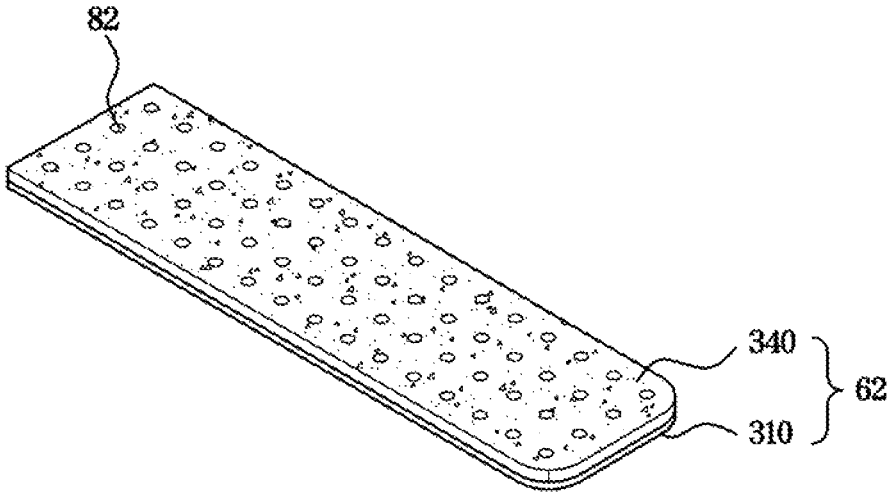
FIG. 7A is a view of another example of the second filter of FIG. 3 according to an embodiment of the present disclosure.
Figure 7B:
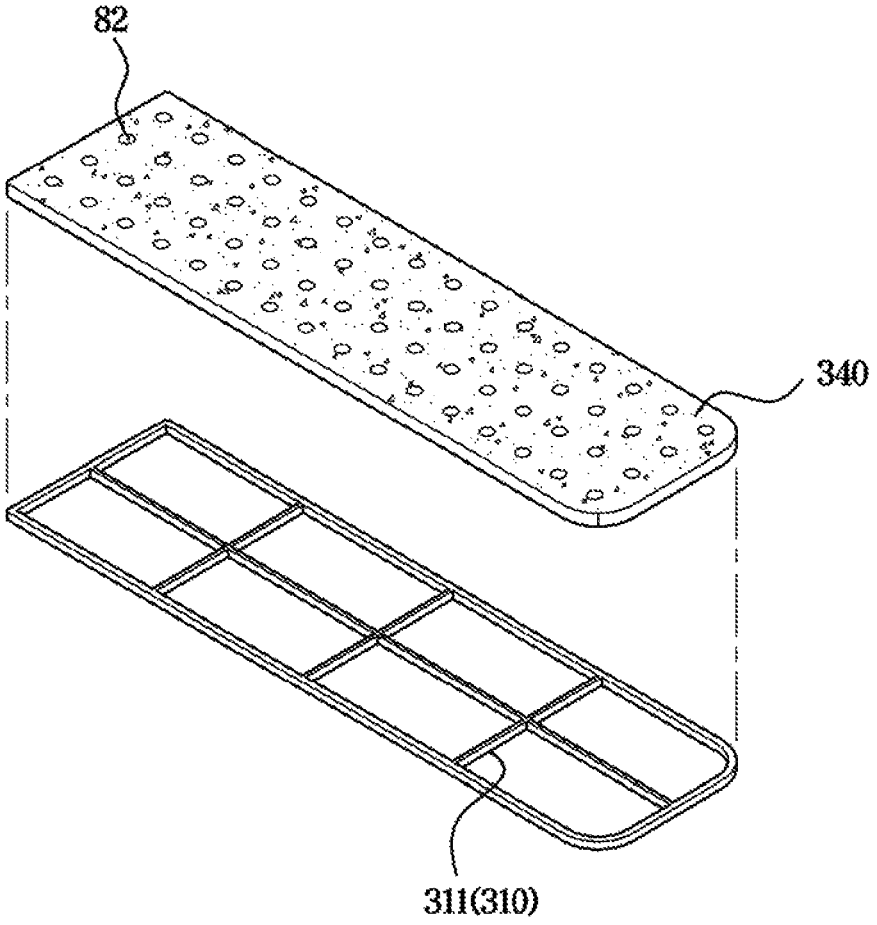
FIG. 7B is an exploded-perspective view of the second filter of FIG. 7A according to an embodiment of the present disclosure.

FIG. 6A is a view of an example of the second filter of FIG. 3, FIG. 6B is an exploded-perspective view of the second filter of FIG. 6A, FIG. 7A is a view of another example of the second filter of FIG. 3, and FIG. 7B is an exploded-perspective view of the second filter of FIG. 7A.

Particularly, the second filter 62 includes a fixing frame 310 and filter members 320 and 340 fixed to the fixed frame 310.

The fixing frame 310 may include a grid-shaped rib 311.

Referring to FIGS. 6A and 6B, a filter member 320 may include a sponge material and may be provided in a mesh shape.

Alternatively, referring to FIGS. 7A and 7B, a filter member 340 may include a metal material. For example, the filter member 340 may be formed of a metal thin film. The metal thin film may be formed of stainless steel such as carbon steel, aluminum, copper, Inconel, or an alloy thereof in order to prevent the formation of rust on the surface. According to the usage condition, a surface-treated material such as painting, tinning and galvanizing may be used and particularly, in the case of high temperature, the surface treatment may be performed with nickel, chromium, aluminum, and copper to improve durability. Based on the filter member 340 formed with the metal thin film, the plurality of holes 82 may be provided on the filter member 340 to filter the air. The plurality of holes 82 may be formed by etching the metal thin film using a fine metal mask.

The filter members 320 and 340 may be fixed to the fixing frame by a double-sided tape or an adhesive, or alternatively, the filter members 320 and 340 may be injection-molded integrally with the fixing frame 310.

Figure 8:
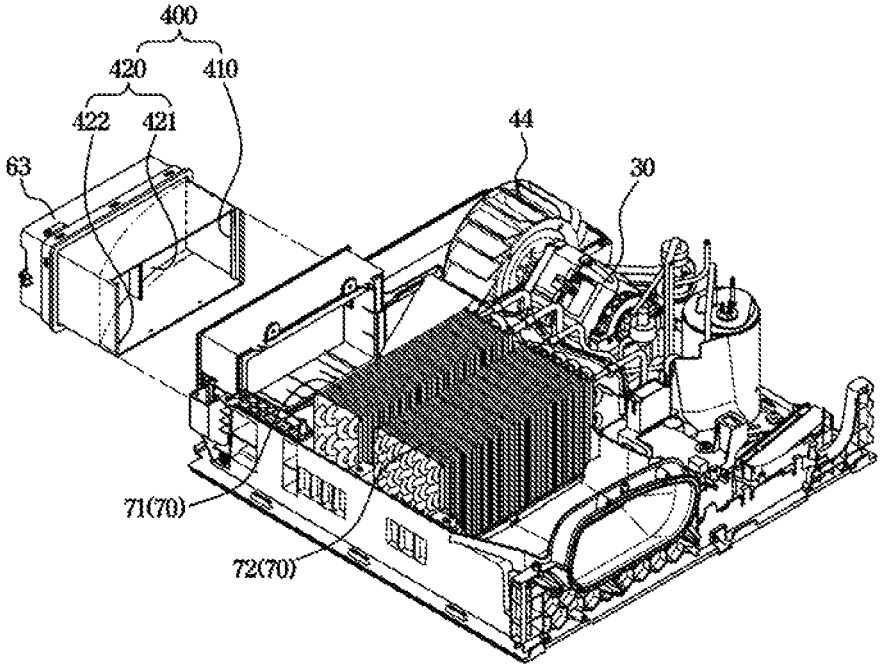
FIG. 8 is a perspective view of the base of FIG. 2 when viewed from another angle according to an embodiment of the present disclosure.
Figure 9:
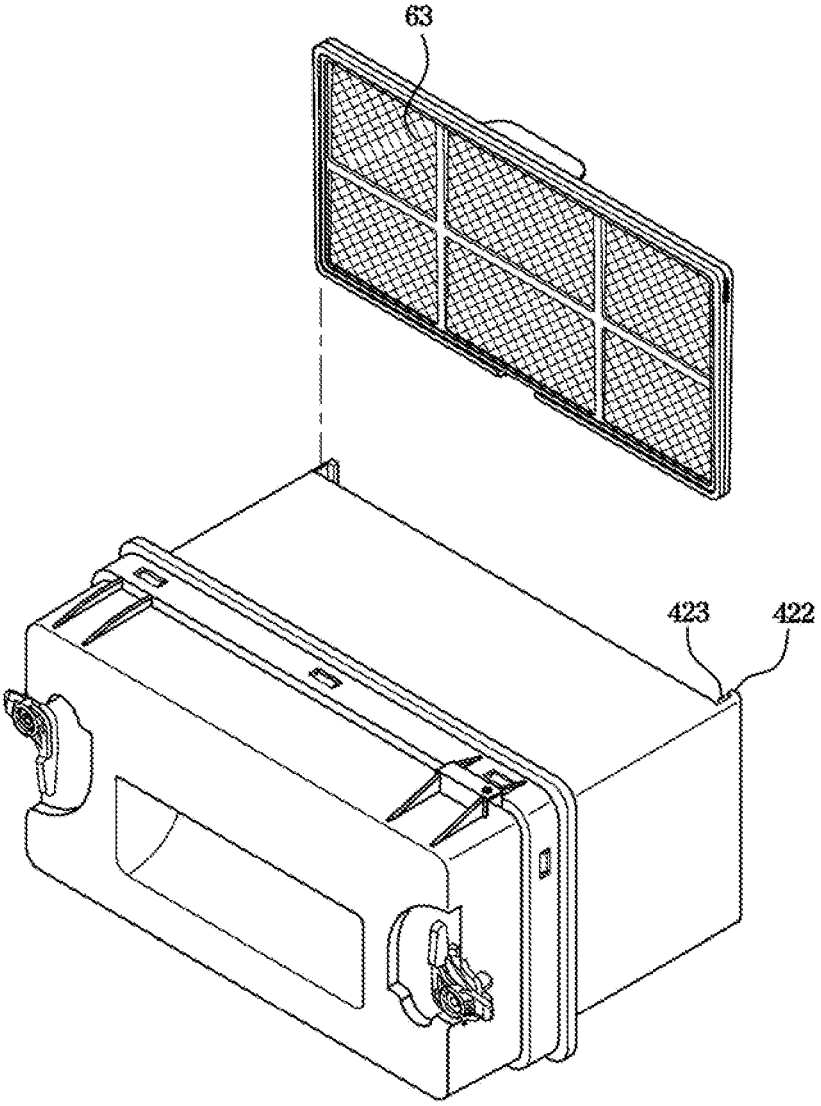
FIG. 9 is a perspective view of a filter assembly of the base of FIG. 8 according to an embodiment of the present disclosure.
Figure 10:
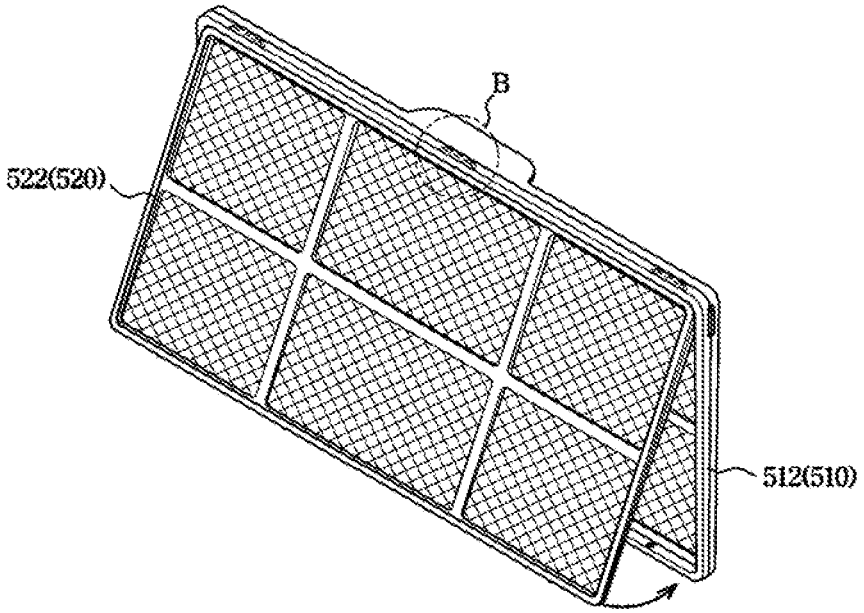
FIG. 10 is a perspective view of a third filter coupled to the filter assembly of FIG. 9 according to an embodiment of the present disclosure.
Figure 11:
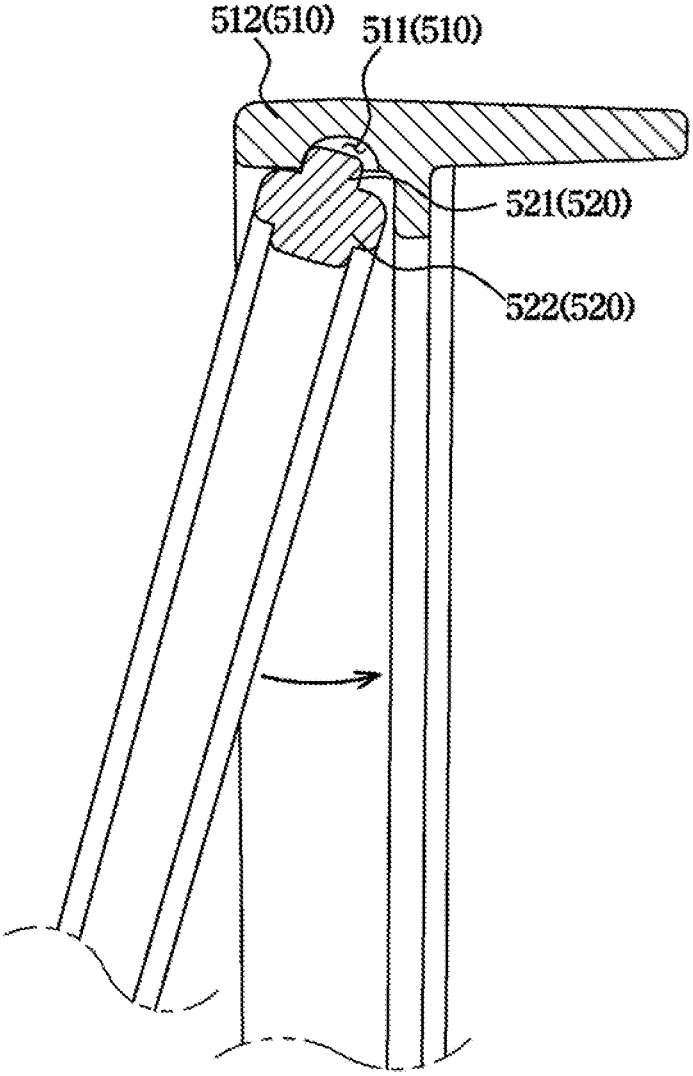
FIG. 11 is an enlarged cross-sectional view of part 'B' of the third filter of FIG. 10 according to an embodiment of the present disclosure.

FIG. 8 is a perspective view of the base of FIG. 2 when viewed from another angle, FIG. 9 is a perspective view of a filter assembly of the base of FIG. 8, FIG. 10 is a perspective view of a third filter coupled to the filter assembly of FIG. 9, and FIG. 11 is an enlarged cross-sectional view of part 'B' of the third filter of FIG. 10.

Referring to FIG. 8, as described above, air may pass through the second filter 62 and move to the inside of the base 100, and the air introduced into a part adjacent to the fan drive inside the base 100 may first move to a filter assembly 400 of the base 100 before moving to the drying unit 70.

That is, the filter assembly 400 may correspond to a component provided in the base 100 to connect the fan drives 30 and 44 and the drying unit 70, and the filter assembly 400 may form a part of the circulation path in which the air moves from the fan drives 30 and 44 to the drying unit 70.

Referring to FIG. 9, the filter assembly 400 may be formed in the form of case in which a space is provided.

Particularly, the filter assembly 400 may include a first side 410 provided to face the fan drives 30 and 44 and opened to allow air to be introduced from the fan drives 30 and 44, and a second side 420 provided to face the drying unit 70 and opened to allow the air, which is introduced from the first side 410, to be guided to the drying unit 70.

Accordingly, the air adjacent to the fan drive may pass through the first side 410 and move to the inside of the filter assembly 400, and then move to the drying unit 70 through the second side 420. Therefore, the air may be dried in the drying unit 70.

A third filter 63 may be coupled to the second side 420 to allow the air to be first filtered at the third filter 63 before moving to the drying unit 70.

The second side 420 includes a coupling member 422 including a coupling groove 423 provided to allow the third filter 63 to be slidably coupled. The coupling groove 423 may be provided in a shape corresponding to opposite sides of the third filter 63.

In a state in which the third filter 63 is coupled to the filter assembly 400 through a fixing member such as a hook, abrasion and whitening of the hook may occur. However, in the present disclosure, the opposite sides of the third filter 63 are coupled to or separated from the filter assembly 400 through sliding, thereby preventing abrasion and whitening of the third filter 63. In addition, when the third filter 63 needs to be replaced, a user can easily separate the third filter 63 from the filter assembly 400 by sliding the third filter 63.

Further, referring to FIGS. 10 and 11, the third filter 63 may include a first filtering member 510 including a mesh shape and a second filtering member 520 including a mesh shape and removably coupled to the first filtering member 510. As described above, the third filter 63 includes a double structure including the first filtering member 510 and the second filtering member 520, thereby improving the efficiency of collecting dust and lint contained in the air.

In addition, when one of the first filtering member 510 and the second filtering member 520 needs to be replaced, a user can separate and replace one of the first filtering member 510 and the second filtering member 520, and if necessary, a user can selectively use one of the first filtering member 510 and the second filtering member 520.

The first filtering member 510 may include an edge 512 provided with at least one groove 511, and the second filtering member 520 may include an edge 522 provided with at least one protrusion 521 corresponding to the at least one groove 511 of the first filtering member 510.

Accordingly, the first filtering member 510 and the second filtering member 520 may be easily coupled to each other by inserting the protrusion 521 of the second filtering member 520 into the groove 511 of the first filtering member 510, and further the first filtering member 510 and the second filtering member 520 may be easily separated from each other.

While the present disclosure has been particularly described with reference to exemplary embodiments, it should be understood by those of skilled in the art that various changes in form and details may be made without departing from the spirit and scope of the present disclosure.

What is claimed is:

1. A clothes dryer comprising:

a main body;

a drum including an entrance provided to allow an object to be dried to be placed in the drum, the drum being installed inside the main body;

a drying unit installed inside the main body to dry air passing through the drum;

a first filter arranged adjacent to the entrance of the drum to filter air discharged from the drum;

a second filter arranged between the first filter and the drying unit so as to filter air passing through the first filter;

a third filter provided to filter air passing through the second filter;

a front frame provided to form a part of a circulation path through which air circulates between the drum and the drying unit, the front frame comprising a bottom flange including an opening facing a lower side of the main body to form a part of the circulation path, the first filter being mounted on the front frame;

a fan drive comprising a fan arranged therein, the fan drive arranged below the front frame so that air flows to the opening; and a filter assembly provided to form a part of the circulation path and connected to the drying unit, the filter assembly comprising:

a first side provided to face the fan drive and formed to be open to allow air to be introduced from the fan drive, and a second side provided to face the drying unit and formed to be open to allow the air, which is introduced from the first side, to be guided to the drying unit;

wherein the second filter is arranged between the first filter and the fan drive, and is provided on the bottom flange in parallel with the lower side of the main body to cover the opening, and the second side comprises a coupling member including a coupling groove provided to allow the third filter to be slidably coupled thereto.

2. The clothes dryer of claim 1, wherein the first filter is formed with a metal thin film comprising a plurality of holes.

3. The clothes dryer of claim 2, wherein the plurality of holes are formed by etching the metal thin film.

4. The clothes dryer of claim 1, wherein the front frame comprises:

a mounting member provided to support one surface of the first filter to allow the first filter to be mounted thereto; and a side flange formed to extend from one side of the mounting member to fix one side of the first filter, and wherein the bottom flange is formed to extend from a lower portion of the mounting member to fix a bottom of the first filter.

5. The clothes dryer of claim 1, wherein the second filter comprises:

a fixing frame comprising a grid-shaped rib; and a filter member fixed to the fixing frame.

6. The clothes dryer of claim 5, wherein the filter member comprises a sponge material and is provided in a mesh shape.

7. The clothes dryer of claim 5, wherein the filter member is formed with a metal thin film comprising a plurality of holes.

8. The clothes dryer of claim 7, wherein the plurality of holes are formed by etching the metal thin film.

9. The clothes dryer of claim 5, wherein the filter member is fixed to the fixing frame by a double-sided tape or an adhesive.

10. The clothes dryer of claim 5, wherein the filter member is injection-molded integrally with the fixing frame.

* * * * *